United States Patent [19]

Castner. Sr. et al.

[11] Patent Number: 4,550,857

[45] Date of Patent: Nov. 5, 1985

[54] COTTON SWAB VENDER

[76] Inventors: J. Fred Castner. Sr., P.O. Box 7156, San Diego, Calif. 92107; John F. Castner, Jr., 7572 Volga Dr. #1, Huntington Beach, Calif. 92647

[21] Appl. No.: 569,771

[22] Filed: Jan. 10, 1984

[51] Int. Cl.[4] ..... B65H 5/28

[52] U.S. Cl. ..... 221/70; 225/44

[58] Field of Search ..... 221/70, 71, 30, 25, 221/155; 225/39, 44, 45; 206/403, 411

[56] References Cited

U.S. PATENT DOCUMENTS 1,122,456 12/1914 Woods .
2,771,214 11/1956 Lefebvre .
2,912,140 3/1957 Cole .
3,217,954 7/1964 Grant et al. .
3,362,578 1/1968 Spencer ..... 221/70 X
3,478,923 11/1969 Fisher .
3,648,836 3/1972 Castner .
3,858,722 1/1975 Haas ..... 221/70 X

*Primary Examiner*—Stanley H. Tollberg

[57] ABSTRACT

A refillable vender or dispenser for cotton swabs releasably carried cross-wise on an elongated flexible tape wound about itself to form a roll has a plurality of mating components releasably held together to define a chamber receiving the roll for rotation about a horizontal axis. The upper portion of the chamber has a chute receiving the leading end of the roll and discharging through a slot to an external lip supporting the exposed tape from which a swab is easily picked off of the tape. A finger hole overlying the chute provides for the pushing of the stick portions of the swabs to successively advance the tape beyond the discharge slot. The discharge slot has a severing edge to tear off that portion of the tape projecting beyond the discharge outlet.

10 Claims, 12 Drawing Figures

FIG. 1
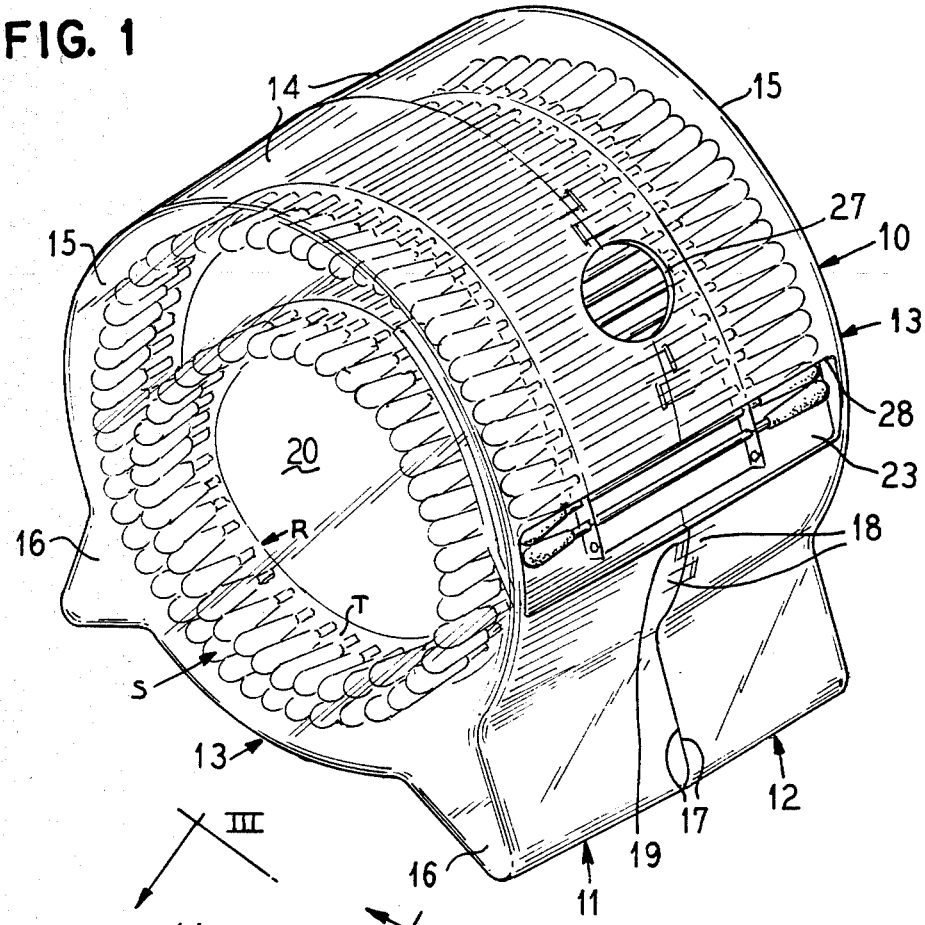
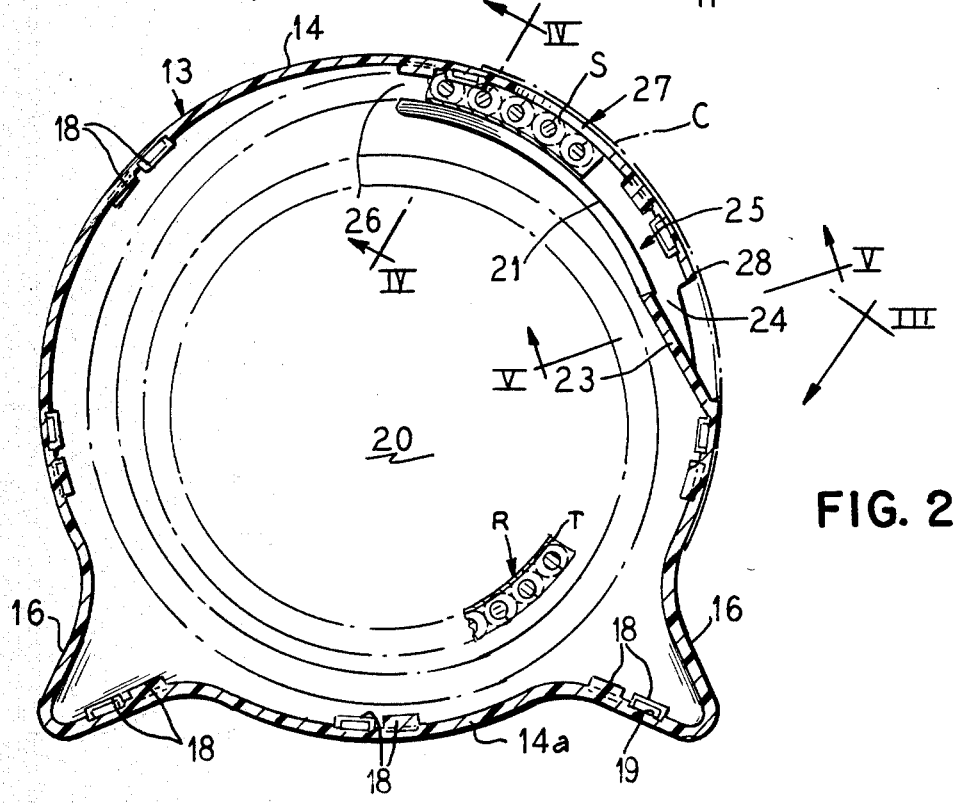
FIG. 2

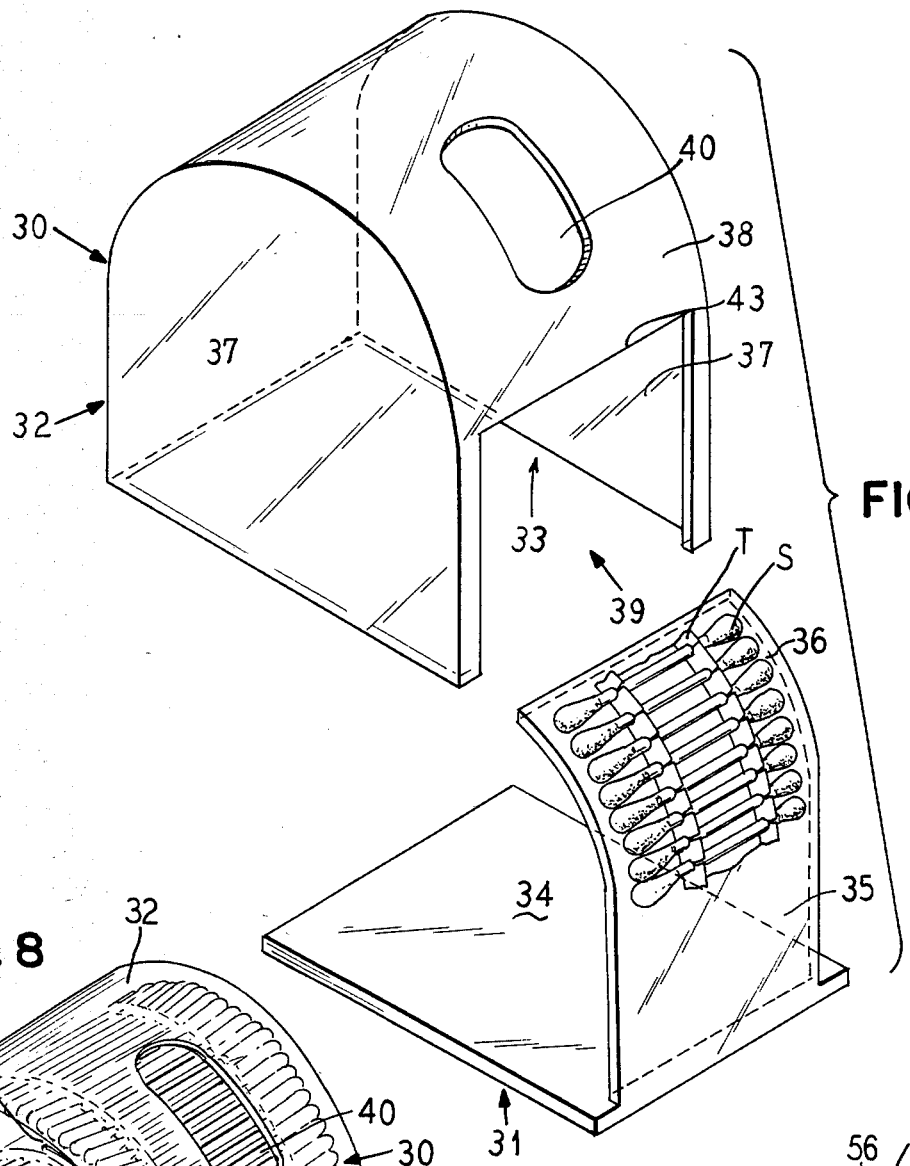
FIG. 9
FIG. 8
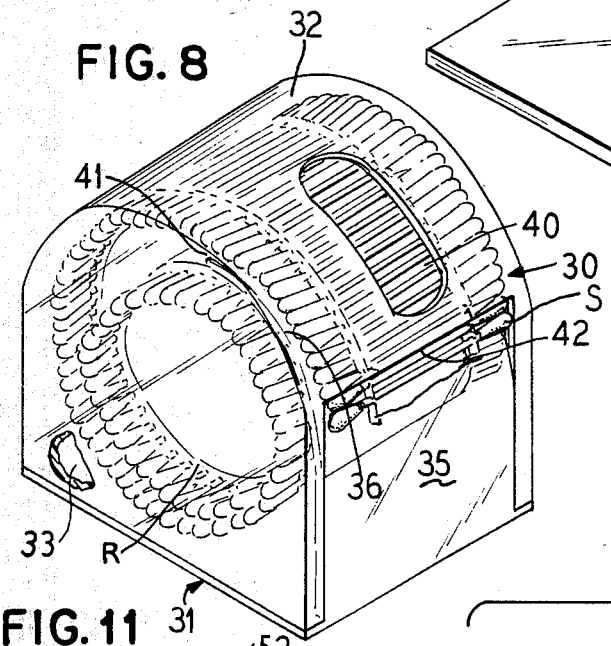
FIG. 10
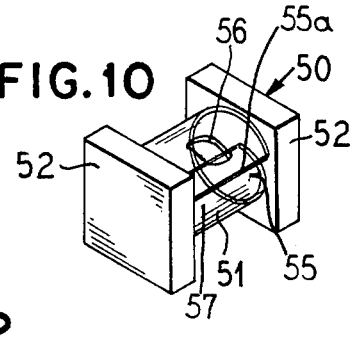
FIG. 11
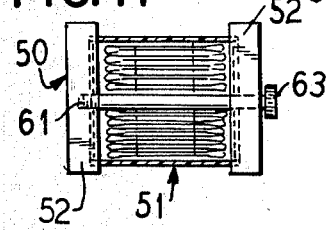
FIG. 12
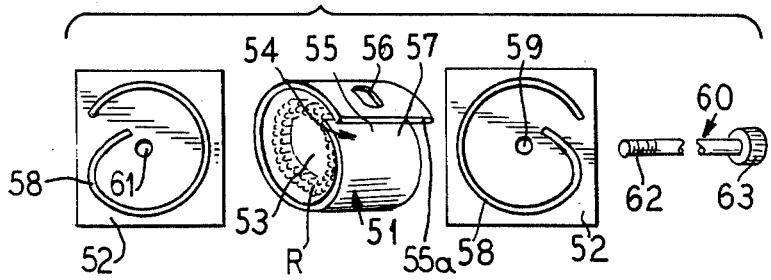

COTTON SWAB VENDER

BACKGROUND OF THE INVENTION

1. Field of the Invention

This invention relates to the art of venders or dispensers and particularly deals with refillable venders having a chamber for cotton swabs which are releasably carried on a tape that is wound about itself to form a roll mounted in the chamber for rotation about a horizontal axis with a discharge chute leading from the chamber supporting and guiding the leading end of the tape and a finger hole providing access to the stick portions of the swabs in the chute to advance the swabs to the discharge outlet.

2. Prior Art

Dispensers or venders for tape carrying products have been proposed. They are not generally useful as permanent refillable devices providing a decorative accessory storing the products under sanitary conditions and conveniently operated with one hand to successively dispense the products. The art of dispensing tape carried cotton swabs is especially deficient in providing the user with an attractive permanent bathroom accessory which will store the swabs under sanitary conditions without deterioration from surrounding moisture.

It would therefore be an improvement in this art to provide cotton swab dispensers which are attractive, easily opened up to receive refills, have a longer wear life, conveniently operated with one hand, and house the swabs under sanitary conditions while protecting them from moisture.

SUMMARY OF THE INVENTION

According to this invention, there are provided cotton swab venders having generally cylindrical chambers receiving a roll of cotton swab carrying tape for free rotation about a horizontal axis and discharging the leading end of the tape through a swab confining arcuate chute with an access hole for advancing the swabs through a discharge outlet to an exposed supporting lip or platform to be picked off of the tape for use. Lengths of the swab freed tape beyond the outlet are conveniently torn off by pulling the tape against a cutting edge at the outlet. The chute snugly embraces the swabs to prevent the leading end of the tape from retracting back into the chamber. The venders are composed of mating components releasably held together to provide a generally cylindrical chamber for the roll, a base support holding the chamber in an upright position, a chute with an inner open end at or near the top of the chamber and an open discharge end also at a high level to prevent the swabs from dipping into puddles such as might occur around the periphery of a sink. The chamber is preferably formed of a transparent plastics material giving a clear view of the roll in the chamber.

It is then an object of this invention to provide reuseable cotton swab venders having a long wear life.

Another object of this invention is to provide cotton swab venders composed of mating components releasably held together to define a generally cylindrical chamber for a roll of swab carrying tape with an arcuate discharge chute receiving the leading end of the tape and a finger hole overlying the central portion of the chute giving access to the stick portions of the successive swabs for advancing them through the chute to a discharge outlet across the width of the chamber.

A still further object of the invention is to provide a cotton swab dispenser composed of snapped together side by side components defining an upright cylindrical chamber and a discharge chute extending from the chamber to an exposed supporting lip or platform.

Another object of the invention is to provide a reuseable cotton swab vender composed of top and bottom molded plastic components snapped together to form a generally cylindrical chamber with an open ended discharge chute.

A still further object of this invention is to provide a cotton swab vender composed of end walls, a central cylindrical tube clamped between the end walls and a discharge chute extending from the interior of the tube across the length thereof.

Other and further objects of this invention will become apparent to those skilled in this art from the description of the annexed sheets of drawings which show several best mode embodiments of the invention.

ON THE DRAWINGS

FIG. 1 is a perspective view of a cotton swab vender of this invention;

FIG. 2 is a central longitudinal cross-sectional view of the vender of FIG. 1;

FIG. 8 is a perspective view of a modified vender according to this invention;

FIG. 9 is an exploded perspective view of the components of the vender of FIG. 8;

FIG. 10 is a perspective view of another modified vender of this invention;

FIG. 11 is a front elevational view of the vender of FIG. 10;

FIG. 12 is an exploded view of the components of the vender of FIGS. 10 and 11.

DESCRIPTION OF THE PREFERRED EMBODIMENTS

Figure 3:
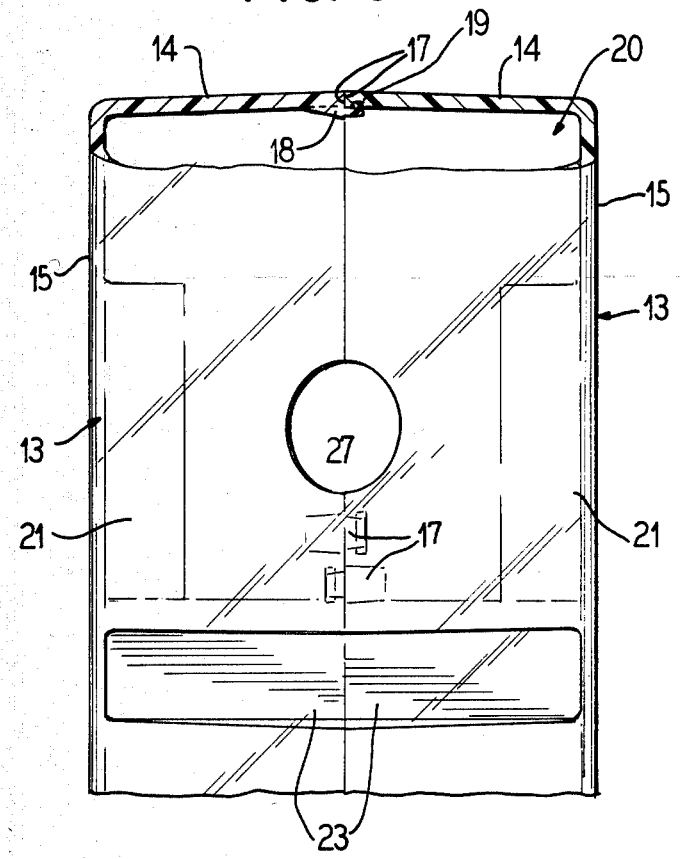
FIG. 3 is a fragmentary plan view along the line III—III of FIG. 2, with a portion broken away and shown in cross-section.

The vender 10 of FIGS. 1 to 7 is composed of a pair of transparent molded plastic mating components 11 and 12 in side by side relation. Each component 11 and 12 has a hollow cup-shaped cylindrical portion 13 with a cylindrical peripheral wall 14, a flat side or end wall 15 and a pair of hollow V-shaped legs 16 bulged outwardly from the cylindrical peripheral wall 14 at the bottom thereof spaced about 45° apart and connected by a somewhat flattened portion **14*a* of the peripheral wall 14. The bottom of this connecting wall portion 14*a*, as shown in FIG. 2, is flush with the bottoms of the legs 16 so that the vender 10 has a three leg support zone resting on a horizontal surface to present the side faces 15** vertically.

Figure 6:
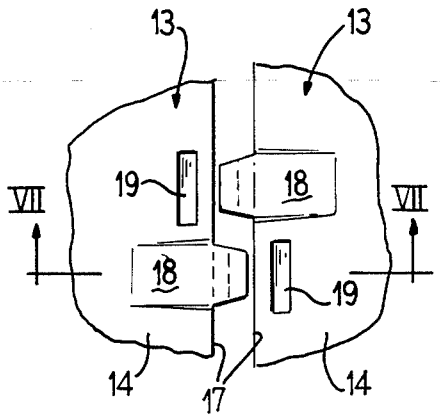
FIG. 6 is a fragmentary plan view showing the two components of the vender in separated condition to illustrate the function of the snap latches.
Figure 7:
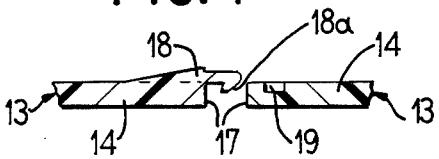
FIG. 7 is a cross-sectional view along the line VII—VII of FIG. 6.
Figure 4:
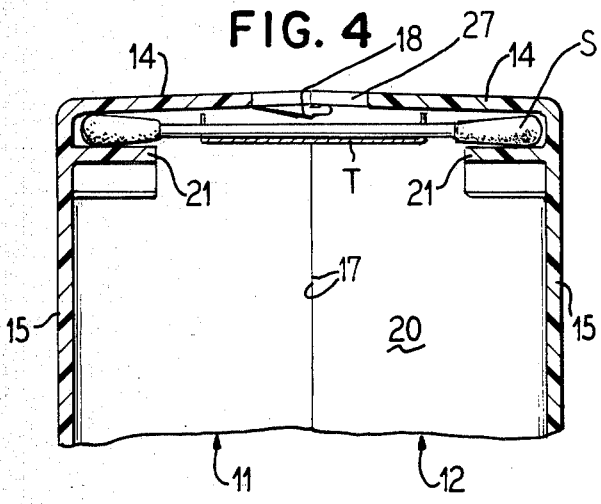
FIG. 4 is a fragmentary transverse sectional view aong the line IV—IV of FIG. 2.
Figure 5:
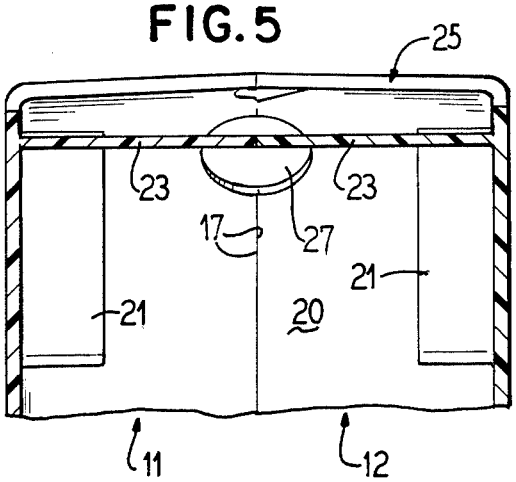
FIG. 5 is a fragmentary transverse sectional view along the line V—V of FIG. 2.

The two cup-shaped cylindrical components 11, 12 have flat rims 17 around their open sides which abut together and are held in abutted face to face sealed engagement by cooperating spring fingers 18 and finger receiving wells 19 on the inner faces of the peripheral wall portions 14 of the components. These fingers and wells are arranged in adjacent pairs at spaced intervals around the peripheral wall 14 and as shown in FIG. 6, the adjacent fingers are formed on opposite components 13 to snap over and mate with the wells or grooves 19 aligned therewith. As shown in FIG. 7, each finger 18 has a hook end 18*a* for snapping into the well or groove 19 of the adjacent component 13. The two components 13 are thus snapped together to form a generally cylindrical chamber 20 with flat vertical side walls 15.

Each component 13 has an arcuate flange 21 extending inwardly from the side wall 15 and spaced inwardly from the peripheral wall 14. These flanges 21 as shown in FIG. 2 extend from the apex of the cylindrical periphery 14 in a clockwise direction to about a two o'clock position where they merge into lip portions 23 which slope inwardly and upwardly from about the three o-clock of the peripheral walls. These lip portions 23 are flat and extend from the side walls 15 to the flat rim portions 17 where they also abut together.

A downwardly opening discharge slot 24 is thus provided across the width of the casing discharging to the exposed lip or platform 23 on the periphery of the casing. This discharge opening or slot 24 is at the open outer end of an arcuate chute 25 provided by the flanges 21 and the overlying peripheral walls of 14. This chute 25 has an inlet mouth 26 at the apex or twelve o'clock position of the cylindrical casing.

The peripheral walls 14 of the components 13 have semicylindrical recesses extending from their abutting rims 17 providing a circular finger hole 27 at about the one o'clock position midway between the discharge slot 24 and the entrance 26 to the chute.

As illustrated in FIGS. 1 and 2, a roll R of a paper tape T releasably carrying cotton swabs S across the width of the tape is freely mounted within the chamber 20. The tape is narrower than the swabs and has upstanding side flanges which are slotted to releasably receive the swab sticks. The cotton ends of the swab project beyond these flanges so that when the tape is wound about itself to form the roll R, the swabs will extend across the width of the chamber 20 with the tape in the mid-section of the chamber. The leading end of the roll is threaded through the opening 26 into the chute 25 with the cotton tips of the swab riding on the flanges 21 and the tape portion of the roll lying between the flanges. The width of the chamber 20 is sufficient to freely receive the roll R with the ends of the cotton tips of the swab lying adjacent the side walls 15 so that the roll remains centered in the chamber to present the swabs to the chute. The chute, however, snugly receives the swabs so that the leading end of the tape will not retract into the cylinder. The chute thus provides a friction passageway.

The finger hole 27 overlies the mid-portions of the sticks in the chute 25 and these mid-portions are easily grasped by the finger of a user to be pulled toward the discharge slot 24 presenting a leading swab over the lip 23 where it is conveniently removed from the tape as the tape is still supported by the lip. Then as successive swabs are removed and a length of tape is exposed over the lip, it is easily grasped and lifted by the user against a severing edge 28 at the discharge slot 24 to be severed from the swab carrying portion of the tape and discarded. The roll R is thus unwound in the chamber 20 presenting a leading end through the chute 25 to the downwardly opening discharge slot 24 for successively presenting swabs over the lip 23 to be removed from the tape. As shown in FIG. 2, a peel-off cover strip C can be adhesively secured to the peripheral wall 14 over the finger hole 27 and over the discharge slot 24 to prevent access to the swabs. Advertising indicia and instructions can be printed on this strip C.

The components 11 and 12 are easily separated by squeezing the peripheral portions 14 to unlatch the fingers from their internal grooves. As shown, the fingers 18 are depressed inwardly with their hook-like ends 18*a* snapping into and out of the internal grooves 19. Distortion of the peripheral portions 14 on which these fingers are formed will displace the hook ends 18*a* from their internal grooves.

As shown in FIG. 2, adjacent pairs of fingers and grooves are also provided in the leg portions 16 and base portion 14*a* as well as at spaced intervals around the peripheral walls 14 to provide fastening means around the entire peripheries of the abutting faces of the components 11 and 12.

It will therefore be understood that the vender 10 is easily opened up to receive refill rolls with the leading edges of these rolls being easily threaded into the chute portions of the components and with the cup-shaped components being easily snapped together to provide a closed chamber sealing the roll R protecting the swabs against external contamination since the chamber is only opened at a high level across the discharge slot 24 with the lip 23 draining downwardly from the slot.

In the modification illustrated in FIGS. 8 and 9, a cotton swab vender 30 is formed of two transparent molded plastic components 31 and 32 cooperating to form a generally cylindrical hollow chamber 33 for receiving a roll R of tape carrying swabs. The component 31 has a flat rectangular base 34 with an upstanding vertical end wall 35 of less width than the base 34 and having an arcuate top end portion 36 overlying the base.

The component 32 has an open bottom, flat side or end walls 37 and a peripheral wall 38 which has an arcuate top and an open front face 39 at the front bottom end thereof. A finger slot 40 is provided in the arcuate peripheral wall 38 above the open face 39.

The open bottom of the component 32 fits snugly and freely around the base 34 of the component 31 with the upstanding vertical wall 35 of this component fitting the window or open front face 39 of the component 32 and with the arcuate portion 36 thereof extending into the chamber in spaced parallel relation underneath the periphery 38. This arcuate portion thus cooperates with the peripheral 38 of the component 32 to provide a chute having an inner open end 41 receiving the leading end of the tape roll and an open outer end providing a downwardly opening discharge slot 42 overlying the wall 35 which provides an exposed lip or platform for the tape.

The two components 31 and 32 fit tightly together and fasteners such as snap fingers (not shown) may be provided to hold them together in locked relation.

The roll R of swab carrying tape is fitted in the generally cylindrical chamber provided by the vender 30 for a rotation about a horizontal axis with its leading end threaded through the chute to be discharged over the front wall 35 through the downwardly opening discharge slot 42. The finger hole 40 exposes the mid-sections of the stick portions of the swabs in the chute so that the sticks may be pulled toward the discharge outlet dispensing the swabs successively. The empty tape portion can also be torn from the swab carrying portion by lifting it against a cutting edge 43 above the slot 42.

It will be understood that the swabs are thus successively dispensed from a closed chamber housing a roll of swab carrying tape in substantially the same manner as described above in connection with the dispenser 10.

The further modified dispenser 50 illustrated in FIGS. 10 to 12 is composed of a transparent molded plastics material tube 51 sandwiched between square end heads 52. The tube 51 provides a generally cylindrical chamber 53 for receiving a roll of the tape R and has a chute 54 opening to the top of the chamber and extending arcuately downwardly therefrom to a discharge slot 55. A finger hole 56 is provided above the chute to advance the tape and swabs through the discharge slot where they rest on the exposed underlying lip or platform 57 to be picked off of the tape and where the empty tape portion can be torn off of the swab carrying portion by lifting it against a tearing edge 55*a* provided above the slot 55.

The tube 51 has open end edges seated in conforming grooves 58 in the inner faces of the blocks 52.

A hole 59 through one block receives a locking pin 60 which extends across the center of the cylindrical chamber 53 provided by the tube 51. The opposite block has an internally threaded well 61 receiving the threaded end 62 of the pin. The pin has a knurled head 63 facilitating tightening the pin to clamp the blocks 52 against the ends of the tube 51.

The roll R is inserted into the chamber 53 of the tube 51, the blocks 52 are abutted against the ends of the tube to fit these ends into the conforming grooves 58, the pin 60 is inserted through the hole 59 of the one block to extend through the center of the roll R and the knurled head 63 is rotated to thread the threaded end 62 of the pin into the threaded well 61 thereby assembling the components.

The leading end of the roll is threaded through the chute 54, the swabs are advanced through the chute by inserting a finger through the finger hole 56 to engage the swab sticks and the swabs are successifly pushed through the discharge slot over the lip provided by the tube in the same manner as described in connection with the dispensers 10 and 30.

From the above descriptions, it will be understood that this invention provides a take apart transparent dispenser for swab carrying tape which houses a roll of the tape, dispenses the leading end of the roll through a chute to a discharge outlet where a lip supports the tape so that the swabs are easily picked from the tape and the empty tape is easily torn off of the swab carrying tape in the chute. The vender is composed of a plurality of mating components which are easily assembled and separated to facilitate insertion of refill rolls of the swab carrying tapes and to seal the roll in cylindrical chambers opening only at a high level of the dispenser at the discharge end of a tape supporting chute.

Although the invention has been described with respect to preferred embodiments, it is not to be so limited as changes and modifications can be made which are within the full intended scope of the invention as defined by the appended claims.

We claim as our invention:

1. A refillable vender for cotton swabs releasably carried cross-wise on an elongated flexible tape wound about itself forming a roll with a leading end which comprises a casing composed of a plurality of mating components, means releasably securing said components together in mated relation to define a chamber with an arcuate top wall receiving said roll for rotation about a horizontal axis with a peripheral wall surrounding the roll and having an open ended arcuate chute with an outer wall defined by said arcuate top wall of the chamber and an inner wall in spaced parallel relation therewith receiving and supporting the leading end at the top of the roll at one end and discharging said leading end of the roll at a lower level at the other end, an exposed support lip extending downwardly and outwardly beyond the discharge end of the chute across the full width of the chute, a finger hole in the arcuate top wall providing for advancing the tape and swabs through the chute to the lip, and a cutting edge on the arcuate top wall above the lip for severing an exposed length of tape.

2. A vender for a roll of tape carrying devices to be dispensed which comprises separable molded cup shaped members having complementary spring fingers and finger receiving grooves holding the cup members in opposed relation defining an upright closed chamber for the roll with a discharge chute at the top end thereof, an exposed tape supporting lip beyond the chute, a finger hole above the chute, and a tear edge between the chute and lip, and said chute being dimensioned to frictionally engage the devices to prevent movement of the tape until the devices are pushed through the chute from the finger hole.

3. A vender for a roll of tape carrying swabs with the swab ends extending laterally beyond the sides of the tape which comprises a pair of molded plastics material cups each having a generally cylindrical periphery, a flat end wall, a rim surrounding an open face thereof opposite the end wall and a projecting foot providing support to hold the cups in upright position, releasable means holding the rims of the cups together to provide a generally cylindrical chamber, each of said cups having an inturned flange extending from the end wall thereof adjacent the cylindrical periphery cooperating to define a chute receiving an end of the swab beyond the tape, each of said cups having inturned lips cooperating with the cylindrical periphery to define a peripheral discharge slot at the end of the chute, said slot extending across the width of the cylindrical periphery of the cups, a finger hole in said cylindrical periphery upstream from the discharge slot, said chute being dimensioned to snugly engage cotton swabs from a roll in the chamber defined by the cups to prevent the swabs from retracting into the chamber, and said finger hole being arranged to permit pushing of the swabs through the chute through the discharge slot to rest on the exposed lip.

4. The vender of claim 1 wherein said components are molded cup members mated together around their open faces and opposed pairs of spring fingers and finger receiving depressions on the cup members secure the members in opposed mating relation.

5. The vender of claim 1 wherein the components are a first member having a flat base with an upstanding end wall having an arcuate top end, and a second component having flat sidewalls and arcuate periphery, an open window receiving the upstanding wall of the first component, and an open bottom receiving the flat base of the first component.

6. The vender of claim 1 wherein the components include a pair of end walls, a tube defining the chamber, the chute and the support lip, and pin means clamping the tube between the end walls.

7. The vender of claim 1 wherein the inner wall of the chute is provided by spaced apart flanges cooperating with the peripheral wall and frictionally receiving the ends of the swabs to prevent the leading end of the roll from retracting into the chamber.

8. The vender of claim 2 wherein the chute has an inlet end at the top of the chamber, an outlet end at a lower level than the inlet end, and a tear edge at said outlet end.

9. The vender of claim 2 wherein the chamber is cylindrical and the chute is an arcuate peripheral portion of the chamber.

10. The vender of claim 2 wherein the chute supports the ends of the devices.

* * * * *